US007595756B2

(12) United States Patent
Lastinger et al.

(10) Patent No.: US 7,595,756 B2
(45) Date of Patent: Sep. 29, 2009

(54) METHODS AND APPARATUS FOR IMPROVING WIRELESS COMMUNICATION BY ANTENNA POLARIZATION POSITION

(75) Inventors: Roc Lastinger, Cave Creek, AZ (US); John Spenik, Phoenix, AZ (US); Brian Woodbury, Gilbert, AZ (US)

(73) Assignee: Rotani, Inc., Scottsdale, AZ (US)

( * ) Notice: Subject to any disclaimer, the term of this patent is extended or adjusted under 35 U.S.C. 154(b) by 525 days.

(21) Appl. No.: 11/584,730

(22) Filed: Oct. 20, 2006

(65) Prior Publication Data

US 2007/0096991 A1 May 3, 2007

Related U.S. Application Data

(60) Provisional application No. 60/732,107, filed on Nov. 1, 2005.

(51) Int. Cl.
*H01Q 1/38* (2006.01)

(52) U.S. Cl. ..... 343/700 MS; 455/63.4

(58) Field of Classification Search ..... 343/700 MS, 343/702; 455/63.4, 561, 562.1
See application file for complete search history.

(56) References Cited

U.S. PATENT DOCUMENTS 6,549,169 B1 * 4/2003 Matsuyoshi et al. ..... 343/702
7,181,258 B2 * 2/2007 Lin et al. ..... 455/575.7
7,373,176 B2 * 5/2008 Chotkowski et al. ..... 455/562.1

* cited by examiner

*Primary Examiner*—Tan Ho
(74) *Attorney, Agent, or Firm*—Letham Law Firm LLC; Lawrence Letham

(57) ABSTRACT

A method, according to various aspects of the present invention, for improving wireless communications between two antennas includes, in any order, orienting the first antenna at a predetermined physical orientation such that the first antenna communicates using a predetermined polarization; orienting the second antenna at substantially the same physical orientation as the first antenna; and rotating the second antenna about 180 degrees such that the second antenna communicates using the same polarization as the first antenna.

8 Claims, 2 Drawing Sheets

METHODS AND APPARATUS FOR IMPROVING WIRELESS COMMUNICATION BY ANTENNA POLARIZATION POSITION

CROSS-REFERENCE TO RELATED APPLICATIONS

This application claims the benefit of, and priority to, copending U.S. Provisional Application No. 60/732,107, filed Nov. 1, 2005, by Lastinger et al., incorporated herein by reference.

BACKGROUND OF THE INVENTION

1. Field of the Invention

This invention pertains generally to methods and apparatus relating to wireless communication.

2. Description of Related Art

Wireless devices generally use antennas to communicate. The radio signals emanating from an antenna may be polarized. Polarization is the orientation of the plane of the wave radiated by an antenna. Polarization may be horizontal (linear), vertical (linear), elliptical, or circular (left or right hand) depending on the design of the antenna. The polarization of the antenna is determined by the orientation of the electric or E-field component within the area of radiation. A radio wave is transmitted and received with maximum intensity when the polarization of the transmitting antenna is substantially the same as the polarization of the receiving antenna. For example, maximum signal strength transfer occurs when the transmitting antenna has a horizontal polarization orientation and the receiving antenna has a horizontal polarization orientation. The radio signal strength communicated between two antennas decreases to the extent that the two antennas do not have the same polarization orientation. The signal strength between a first antenna and a second antenna reaches a minimum when the polarization orientation of the first antenna is orthogonal to the polarization orientation of the second antenna as, for example, when the first antenna has a horizontal polarization orientation and the second antenna has a vertical polarization orientation. Using antennas with different polarization orientations may be used to reduce interference between antennas.

The physical orientation of an antenna may determine its polarization orientation. Generally, antennas are mounted to achieve a desired polarization orientation and adjusted at the time of installation to increase transmission or reception of radio wave signal strength for the desired orientation.

BRIEF SUMMARY OF THE INVENTION

A method, according to various aspects of the present invention, for improving wireless communications between two antennas includes, in any order, orienting the first antenna at a predetermined physical orientation such that the first antenna communicates using a predetermined polarization; orienting the second antenna at substantially the same physical orientation as the first antenna; and rotating the second antenna about 180 degrees such that the second antenna communicates using the same polarization as the first antenna.

BRIEF DESCRIPTION OF THE DRAWINGS

Embodiments of the present invention will now be further described with reference to the drawing, wherein like designations denote like elements, and.

DETAILED DESCRIPTION OF EXEMPLARY EMBODIMENTS

Methods and apparatus according to various aspects of the present invention comprise antennas, radiating elements, feed wires, mounting devices, antenna physical orientation, and radio signal polarization. The mounting devices may of any type and any material adapted to constructively cooperate with antenna operation and/or to not interfere with antenna operation. The antennas may be physically oriented in any manner. The antennas may provide any type of polarization orientation, for example, horizontal, vertical, elliptical, and circular (left or right hand).

Figure 1:
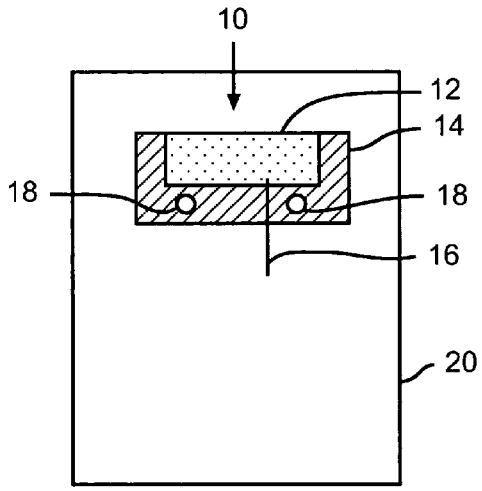
FIG. 1 is a diagram of a top view of an exemplary antenna mounted at a desired physical orientation.
Figure 2:
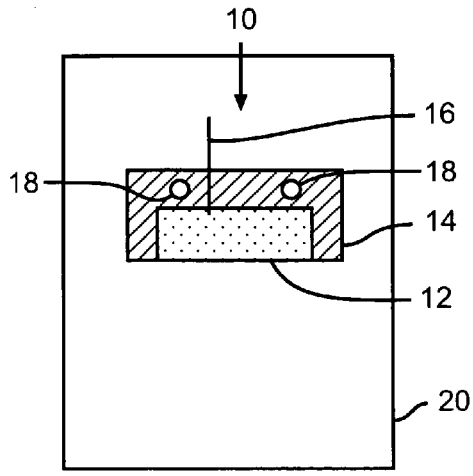
FIG. 2 is a diagram of a top view of an exemplary antenna mounted at a physical orientation that differs from the physical orientation of the antenna in FIG. 1 by about 180 degrees.
Figure 3:
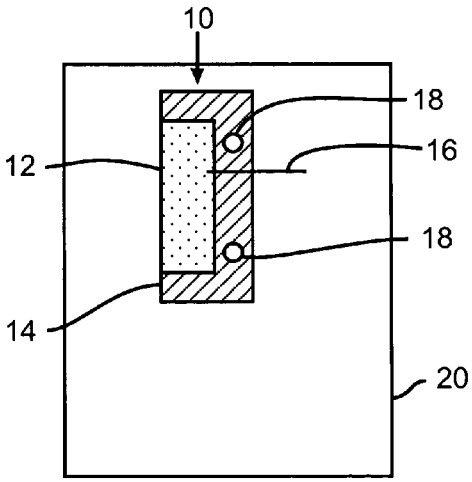
FIG. 3 is a diagram of a top view of an exemplary antenna mounted at a desired physical orientation.
Figure 4:
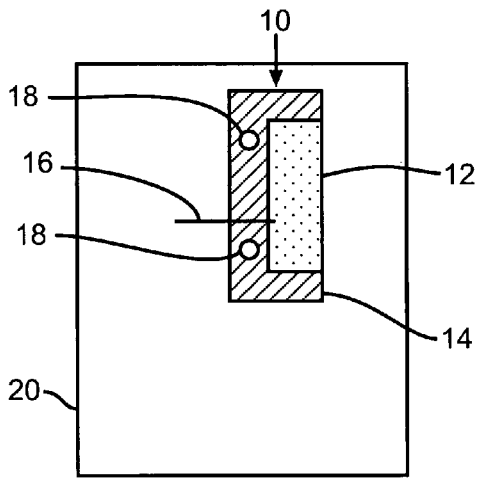
FIG. 4 is a diagram of a top view of an exemplary antenna mounted at a physical orientation that differs from the physical orientation of the antenna in FIG. 3.

In particular, referring to FIG. 1, an antenna 10 according to various aspects of the present invention comprises a radiating element 12, back plane 14, mounting device 18, and feed wire 16. Antenna 10 may be mounted to mounting surface 20. Mounting surface 20 may be conductive and operate as a grounding plane, or non-conductive, or a semi-conductor. Antenna 10 may radiate signals having a predetermined polarization. The physical orientation of antenna 10 may enable antenna 10 to provide a desired polarization orientation. For example, in one embodiment, antenna 10 radiates a radio signal with a linear polarization that is oriented horizontally. In one embodiment, orienting antenna 10 as shown in FIG. 1 or FIG. 2 enables antenna 10 to provide a horizontal polarization. In another embodiment, the physical orientation of antenna 10 as shown in FIG. 3 or FIG. 4 enables antenna 10 to provide a vertical polarization.

The antennas may be of any type. For example, the antennas may be patch, microstrip patch, meander line, dipole, ¼ wave dipole, ½ wave dipole, ceramic, planar inverted F (PIFA), linear inverted F (IFA), and isolated magnetic dipole. The antennas may have any characteristics, for example, voltage standing wave ratio, polarization, efficiency, impedance, wavelength, radiation resistance, reflection coefficient, center frequency, gain, peak gain, directivity, dual resonant, and return loss. The active element of the antenna may be made of any material suitable for the application. The feed wires may be any type of conductive material or combination of conductive material and shielding suitable for the application and frequency range of use. In an exemplary embodiment, the antenna is an isolated magnetic dipole antenna adapted to communicate using radio frequencies commonly used by IEEE 802.11 wireless devices. In another embodiment, the antenna is a model M803 antenna produced by Ethertronics, Inc. In another embodiment, the antenna is a microstrip patch antenna that provides linear polarization.

Antenna 10 may be mounted in any manner using any type of mounting device. For example, referring to FIG. 1, back plane 14 may be non-conductive while the mounting device 18 is conductive. In an exemplary embodiment, back plane 14 is conductive and mounting device 18 is a screw made of Teflon.

Antenna 10 may be mounted at any physical orientation to provide any desired polarization orientation. In an exemplary embodiment, referring to FIG. 1, antenna 10 is physically oriented such that the radiating element provides horizontally polarized radio waves. In another embodiment, referring to FIG. 3, antenna 10 is physically oriented to provide a vertical polarization orientation. In another embodiment, antenna 10 is physically oriented at an angle that lies between the orientations that provide horizontal and vertical polarization orientation.

Figure 5:
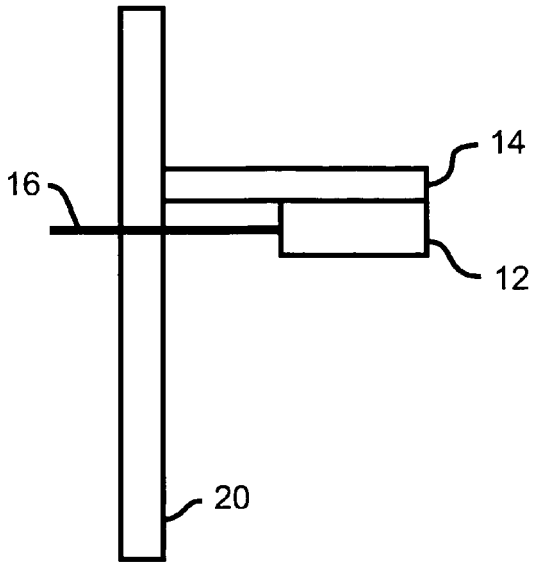
FIG. 5 is a diagram of a side view of an exemplary antenna mounted at a desired physical orientation.
Figure 6:
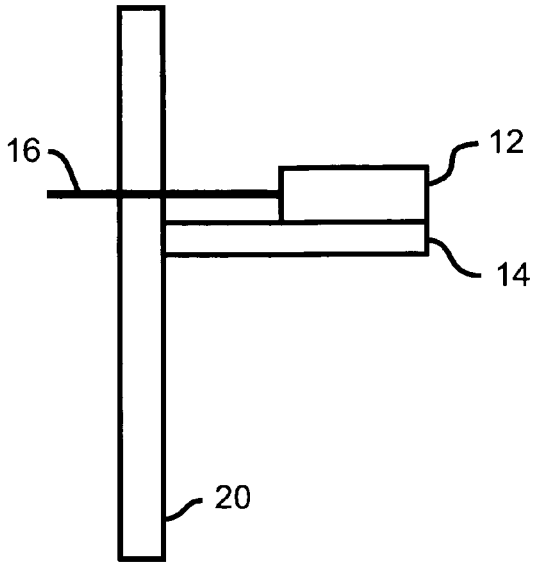
FIG. 6 is a diagram of a top view of an exemplary antenna mounted at a physical orientation that differs from the physical orientation of the antenna in FIG. 5 by about 180 degrees.

Communication between wireless devices may be improved by using substantially similar antenna polarization orientations for each wireless device; however, communication may experience additional improvement by using antennas with similar polarization orientation, but different physical orientation. For example, antenna 10 of FIG. 1 has a physical orientation that transmits and receives horizontally polarized radio waves. Wireless communications between two wireless devices where each one wireless device using an antenna of similar structure and similar physical orientation as depicted in FIG. 1 provides a base level radio signal strength. However, wireless communication between two wireless devices where a first wireless device uses the physical orientation shown in FIG. 1 and a second wireless device uses the physical orientation shown in FIG. 2 produces a radio signal strength that is greater than the base level produced when both antennas use the same physical orientation. In an exemplary embodiment, antenna 10 with physical orientation of FIG. 1 transmits and receives horizontally polarized radio waves. The antenna 10 of FIG. 2 has similar structure to the antenna if FIG. 1, but a physical orientation that is rotated 180 degrees from the physical orientation of the antenna of FIG. 1 in either a clockwise or a counterclockwise direction. An antenna may be rotated on any axis. The axis of orientation may be defined in any manner, for example, as Cartesian planes oriented orthogonally in an x, y, and z directions. In particular, referring to FIGS. 1 and 2, assume that the x-axis runs along the bottom of the paper, the y-axis along the left side of the paper and the z-axis points out of the paper, orthogonal to the surface of the paper. Antenna 10 of FIG. 2 is 180 degrees rotated around the z-axis as compared to the physical orientation of antenna 10 of FIG. 1. In another embodiment of the antenna physical orientation, referring to FIGS. 5 and 6, antenna 10 of FIG. 6 is rotated 180 degrees around the x-axis as compared to the physical orientation of antenna 10 of FIG. 5.

Even though antenna 10 of FIG. 2 has a different physical orientation from antenna 10 of FIG. 1, both antennas transmit and receive horizontally polarized radio waves. Yet, the signal strength transmitted and received between antennas of physical orientation that differ by about 180 degrees is greater than the signal strength transmitted and received between antennas of similar structure and similar physical orientation. Additionally, different physical orientation may increase the signal-to-noise ratio between two communicating antennas.

In another embodiment, referring to FIG. 3, antenna 10 is physically oriented to communicate using vertically polarized radio waves. Antenna 10 of FIG. 4 also communicates using vertically polarized radio waves, but the physical orientation of antenna 10 of FIG. 4 is 180 degrees rotated from the physical orientation of antenna 10 of FIG. 3. Communications between antenna 10 of FIG. 3 and antenna 10 of FIG. 4 produce higher radio signal strength than communications between antennas with the same physical orientation. An antenna may be physically oriented at any angle.

The foregoing description discusses exemplary embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A method for improving wireless communications between a first antenna and a second antenna, the method comprising:

orienting the first antenna at a predetermined physical orientation, wherein the first antenna communicates using a predetermined polarization;

orienting the second antenna at substantially the same physical orientation as the first antenna;

rotating the second antenna about 180 degrees, wherein the second antenna communicates using the same polarization as the first antenna.

2. The method of claim 1, wherein the first antenna and the second antenna each comprise a magnetic dipole antenna.

3. The method of claim 1, wherein the first antenna and the second antenna each comprise an inverted F antenna.

4. The method of claim 1, wherein the first antenna and the second antenna each comprise a microstrip patch antenna.

5. The method of claim 1, wherein the second antenna is rotated around at least one of the x-axis, the y-axis, and the z-axis.

6. The method of claim 1, wherein the first antenna and the second antenna each have substantially similar structure.

7. A system for communicating wirelessly using a radio signal of a predetermined polarization, the system comprising:

a first wireless cell having a first antenna; wherein the first antenna has a first structure, a first physical orientation, and transmits and receives radio signals of a first polarization;

a second wireless cell having a second antenna; wherein the second antenna has a second structure substantially similar to the first structure, a second physical orientation, and transmits and receives radio signals of the first polarization, wherein the second physical orientation is rotated 180 from the first orientation.

8. The method of claim 7, wherein the first antenna and the second antenna each comprise an inverted F antenna.

* * * * *